US005799938A

United States Patent [19]

Lewis

[11] Patent Number: 5,799,938

[45] Date of Patent: Sep. 1, 1998

[54] BALL AND RING GAMES AND GAME STRUCTURES

[76] Inventor: Ronald L. Lewis, 4253 Billoups St., Baton Rouge, La. 70802

[21] Appl. No.: 909,571

[22] Filed: Aug. 12, 1997

[51] Int. Cl.[6] ..... A63B 67/06; A63B 67/00; A63B 63/00

[52] U.S. Cl. ..... 273/118 R; 273/336; 273/338; 273/127 R

[58] Field of Search ..... 273/127 R, 108, 273/118 R, 126 R, 336, 338; 473/415, 459, 470, 476, 478

[56] References Cited

U.S. PATENT DOCUMENTS

| | | | |
|---|---|---|---|
| 2,525,881 | 10/1950 | Felter | 273/127 R |
| 3,583,702 | 6/1971 | Glass et al. | 273/108 X |
| 3,690,664 | 9/1972 | Hauke | 273/118 R X |
| 4,180,266 | 12/1979 | Morin et al. | 273/338 |
| 4,726,591 | 2/1988 | Johnson | 273/338 X |
| 4,898,392 | 2/1990 | Goletz . | |
| 4,957,290 | 9/1990 | Major et al. . | |
| 4,966,373 | 10/1990 | Houle | 273/338 X |

*Primary Examiner*—Raleigh W. Chiu

*Attorney, Agent, or Firm*—John F. Sieberth; R. Andrew Patty II

[57] ABSTRACT

A game structure for use on a horizontal or substantially horizontal surface, the structure comprising a shaft one or more loop members, the shaft including two support members extending from each end of the shaft for supporting the shaft in a horizontal or substantially horizontal position above the surface; and each loop member occupying a respective plane and being rotatably connected or connectable to the shaft at the loop periphery so that when the loop member is disposed below the shaft and in contact with or in close proximity to said surface, the loop member may rotate about a vertical or substantially vertical axis which extends through the respective plane. Game structure including different combinations of additional components, and games playable on a horizontal or substantially horizontal surface comprised of game structure of this invention in combination with other game components to permit ball rolling games, ring toss games, games which require a suspended net, and combinations thereof.

17 Claims, 5 Drawing Sheets

BALL AND RING GAMES AND GAME STRUCTURES

TECHNICAL FIELD

This invention relates to games in which one of the objects is to roll a ball on a firm surface though a defined space. This invention also relates to ring toss games, as well as to volleyball and other games which require the use of a suspended net.

SUMMARY OF THE INVENTION

The present invention provides unique games and game structures which combine features and advantages in which eye-hand coordination and color coordination are challenged while providing player entertainment and physical exercise. In one embodiment of this invention, a game structure for use on a horizontal or substantially horizontal surface is provided. The structure comprises a shaft and one or more loop members, the shaft including two support members extending from each end of the shaft for supporting the shaft in a horizontal or substantially horizontal position above the surface, and each loop member occupying a respective plane and being rotatably connected or connectable to the shaft at the loop periphery so that when the loop member is disposed below the shaft and in contact with or in close proximity to (i.e., within about 1 inch from) the surface, the loop member may rotate about a vertical or substantially vertical axis which extends through the respective plane. Preferably, each loop member has connected thereto a bar which extends radially from the loop periphery along the axis of loop member rotation. In this preferred embodiment, the bar is sized and configured to be rotatably connectable to the shaft and to extend above the shaft an appreciable distance (preferably at least about 3 inches) when connected to the shaft and when the loop member is disposed below the shaft in contact with or in close proximity to the surface.

In another embodiment, this invention provides a game structure for use on a horizontal or substantially horizontal surface which comprises two or more shafts and a plurality of loop members. Each shaft comprises two support members extending from each end of the shaft for supporting the shaft in a horizontal or substantially horizontal position above the surface. Each loop member occupies a respective plane and is rotatably connected or connectable to the shaft at the loop periphery so that when the loop member is disposed below the shaft and in contact with or in close proximity to the surface, the loop member may rotate about a vertical or substantially vertical axis which extends through the respective plane.

This invention also provides a game playable on a horizontal or substantially horizontal surface, the game comprising the game structure described above in which the bar extends about the shaft and a plurality of rings. Each ring is characterized by an inner diameter sufficient to enable the ring to surround at least one of the bars. This component of the game may be considered the ring-toss component. Preferably, the game further comprises one or more balls, each ball being characterized by a diameter which is sufficiently small to enable the ball to be rolled through at least one loop member when the loop member is rotatably connected to one of the shafts and disposed below the shaft in contact with or in close proximity to the surface. This component of the game may be considered the ball and loop component. In another preferred embodiment, the game further comprises one or more clubs for applying force necessary to roll the balls. Even more preferably, the game further comprises a net and two or more poles, each pole being connected or connectable to one of the shafts respectively and extending above the shaft when connected thereto and when the shaft is supported by the support members. In this way, the net may be deployed to extend from one pole to the other to provide the deployed net necessary for a variety of games, including, for example, volleyball, badminton, water polo, and the like. This component of the game may be considered the supported net component.

As may now be appreciated, there are a variety of combinations of the various components of the game of this invention which may be used in play. For example, the ball and loop component may be combined with the supported net component and/or with the ring toss component. These and other features and advantages of this invention will become even more evident from the following drawings, detailed description and appended claims.

BRIEF DESCRIPTION OF THE DRAWINGS

In each of the above figures, like numerals are used to refer to like parts or functionally like parts among the several figures.

DETAILED DESCRIPTION OF THE INVENTION

Figure 1:
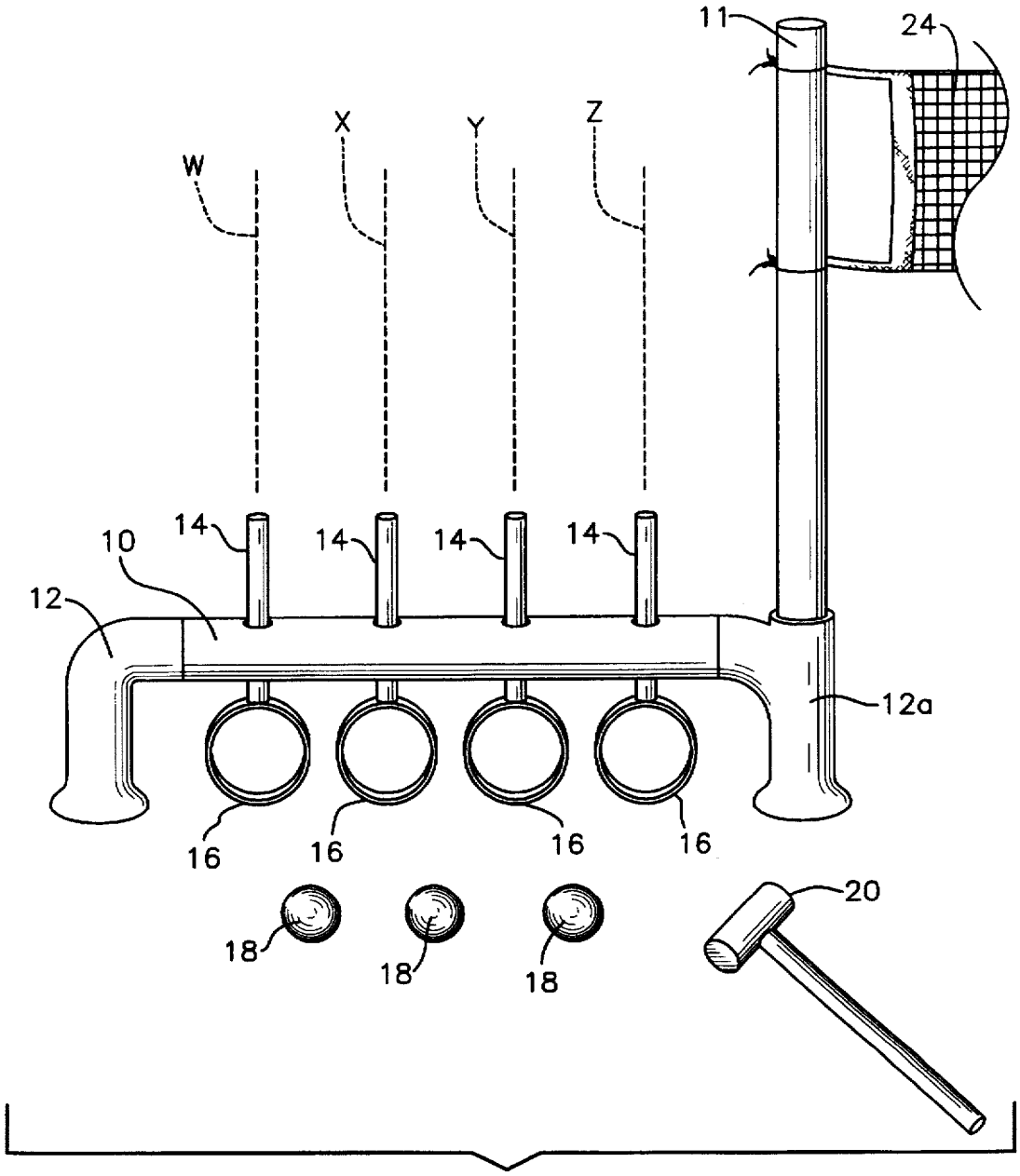
FIG. 1 is a side view of one-half of an embodiment of this invention.

Referring now to the drawings, FIGS. 1–4 illustrate one embodiment of the invention. The game illustrated includes game structure having two shafts 10, a support member 12 and a modified support member 12*a* for each shaft 10, a plurality of bars 14 extending vertically through respective apertures in shafts 10, and a plurality of loop members 16. As depicted, the game further includes two poles 11 (shown together on FIG. 3 only), a plurality of balls 18, a club 20, a plurality of rings 22 and a net 24. Each shaft 10 is supported in a horizontal or substantially horizontal position by support members 12 and 12*a*, which may be permanently or detachably connected to the shaft or integral therewith. As depicted, support members 12 and 12*a* are detachable from shafts 10. Each modified support member 12*a* is configured so that one of the poles 11 may be detachably connected thereto by threaded engagement, snap-in connection, or any other conventional method. In this way, each pole 11 may be detachably connected to its respective shaft 10 via detachable connection to its corresponding support member 12*a*. The detachable features of the game structure depicted facilitate storage and transportation thereof.

As may be seen from FIG. 1, each loop member 16 is disposed within a respective plane and below one of the respective shafts 10. Each bar 14 is sized to fit through an aperture in one of shafts 10 and to rotate within that aperture relative to the shaft. Each bar 14 depicted is circular in cross-section (cut transverse to the longitudinal axis), although the cross-sectional shape of the bars may vary and could take the form of, for example, a square, triangular or elliptical shape, as long as the bars may rotate relative to their respective shaft 10 when connected thereto. Each bar 14 is also attached at one end to the periphery of one of the loop members 16 respectively, so that each bar 14 extends radially from the corresponding loop periphery and through an aperture in respective shaft 10. When loop members 16 are in contact with or close proximity to a horizontal or substantially horizontal surface S, bars 14 also extend above their respective shaft 10 by an appreciable distance, preferably at least about 3 inches, more preferably at least about 6 inches. This distance also may vary from one bar to the next and uniformity in this regard is not required. Surface S is preferably no greater than about 45 degrees from horizontal. Each bar 14 and its associated loop member 16 is rotatable relative to the corresponding shaft 10 about a respective vertical or substantially vertical axis of loop rotation, as illustrated by lines W,X,Y,Z at FIG. 1. Each axis is preferably no greater than about 30 degrees from vertical. Each bar 14 extends along the axis of loop member rotation, and each bar 14 and the respective axis of loop member rotation occupy the same plane occupied by loop member 16. In this way, each loop member 16 is indirectly and rotatably connected to one of shafts 10 through connection to its corresponding bar 14. It will be appreciated that there are a variety of alternative ways in which loop members 16 could be directly or indirectly rotatably connected to their respective shafts 10, and any conventional method may be used as long as each loop member is rotatable relative to its respective shaft.

Figure 2:
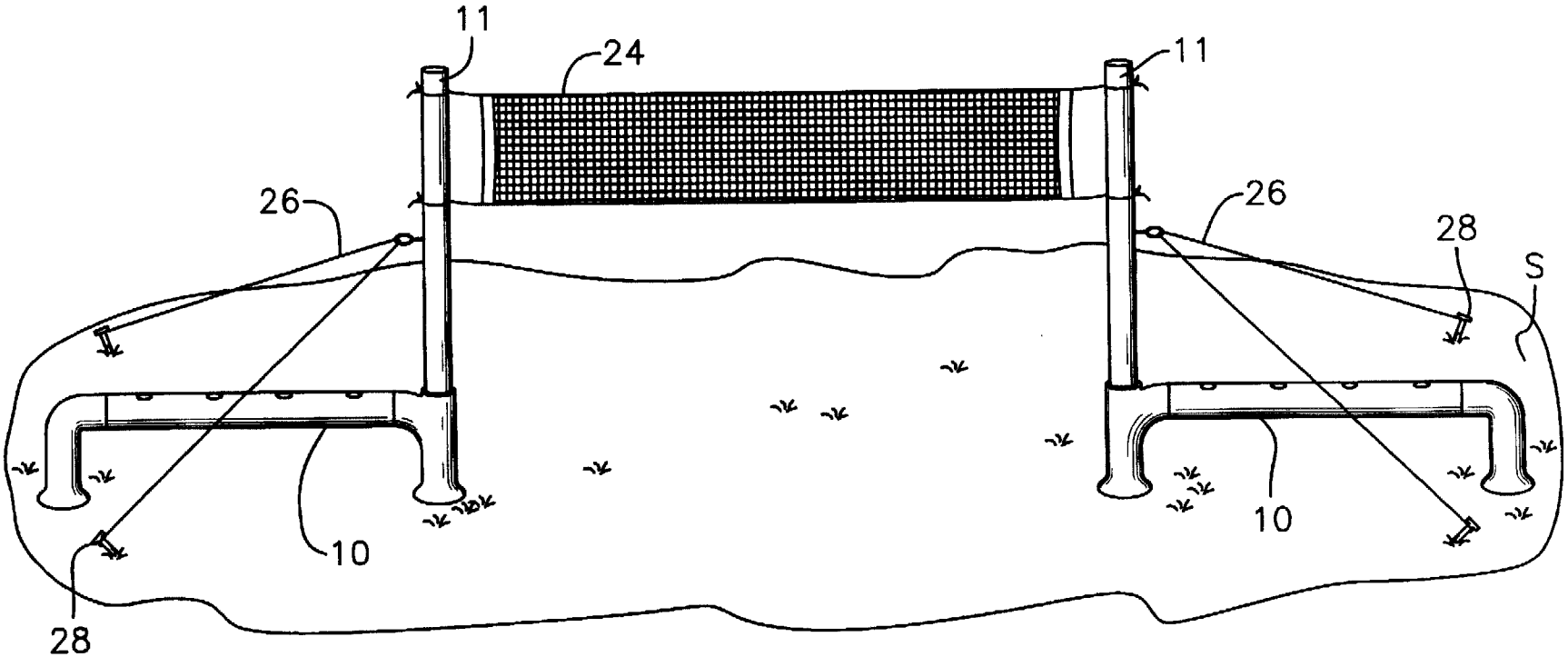
FIG. 2 is an elevated view in perspective of the embodiment of FIG. 1 configured for a game which requires the presence of a suspended net.

FIG. 2 illustrates a game of this invention in which net 24 is deployed to extend between poles 11 when poles 11 are attached to their respective modified support members 12*a*. Each of poles 11 extend above their respective shafts 10 when indirectly or directly connected thereto and when the shaft is supported in a horizontal or substantially horizontal position by the support members. Net 24 as depicted is connected to each pole through string ties at the ends of net 24, although those skilled in the art will appreciate that net 24 may be attached to poles 11 using a variety of conventional methods, such as, for example, hooks, snaps, adhesive and male hook/female loop textile materials, among others. Net 24 and the accompanying game structure may be provided with additional support through a plurality of support lines 26 which are anchored to surface S by stakes 28. Alternatively, support members 12 and 12*a* could be anchored directly to the ground by stakes 28. Games which require a suspended net such as volleyball, tennis, badminton, and water polo, and which include the above-described features are a few non-limiting examples of the games within the scope of this invention.

Figure 3:
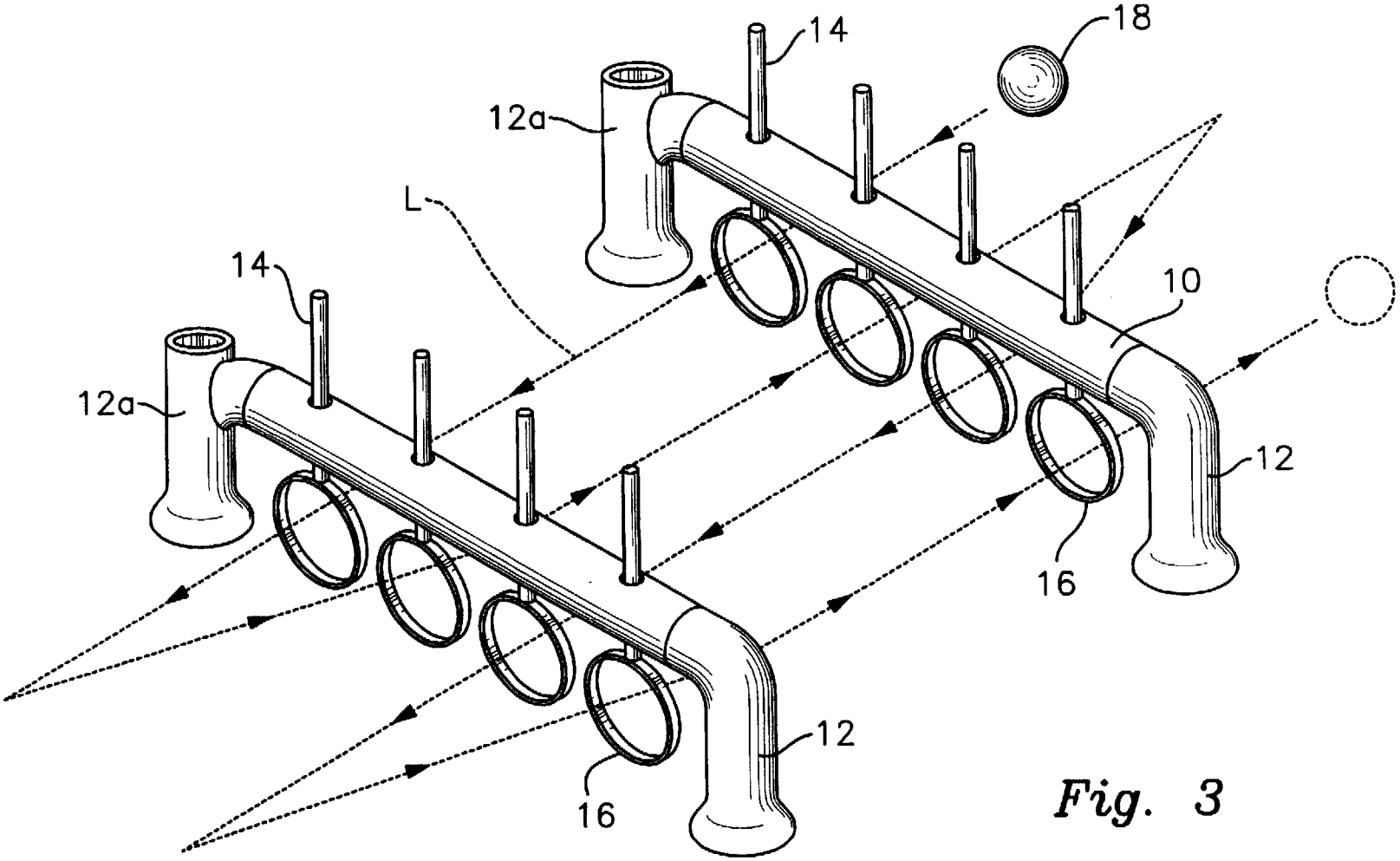
FIG. 3 is an elevated view in perspective of the embodiment of FIG. 1 configured for a ball game.
Figure 4:
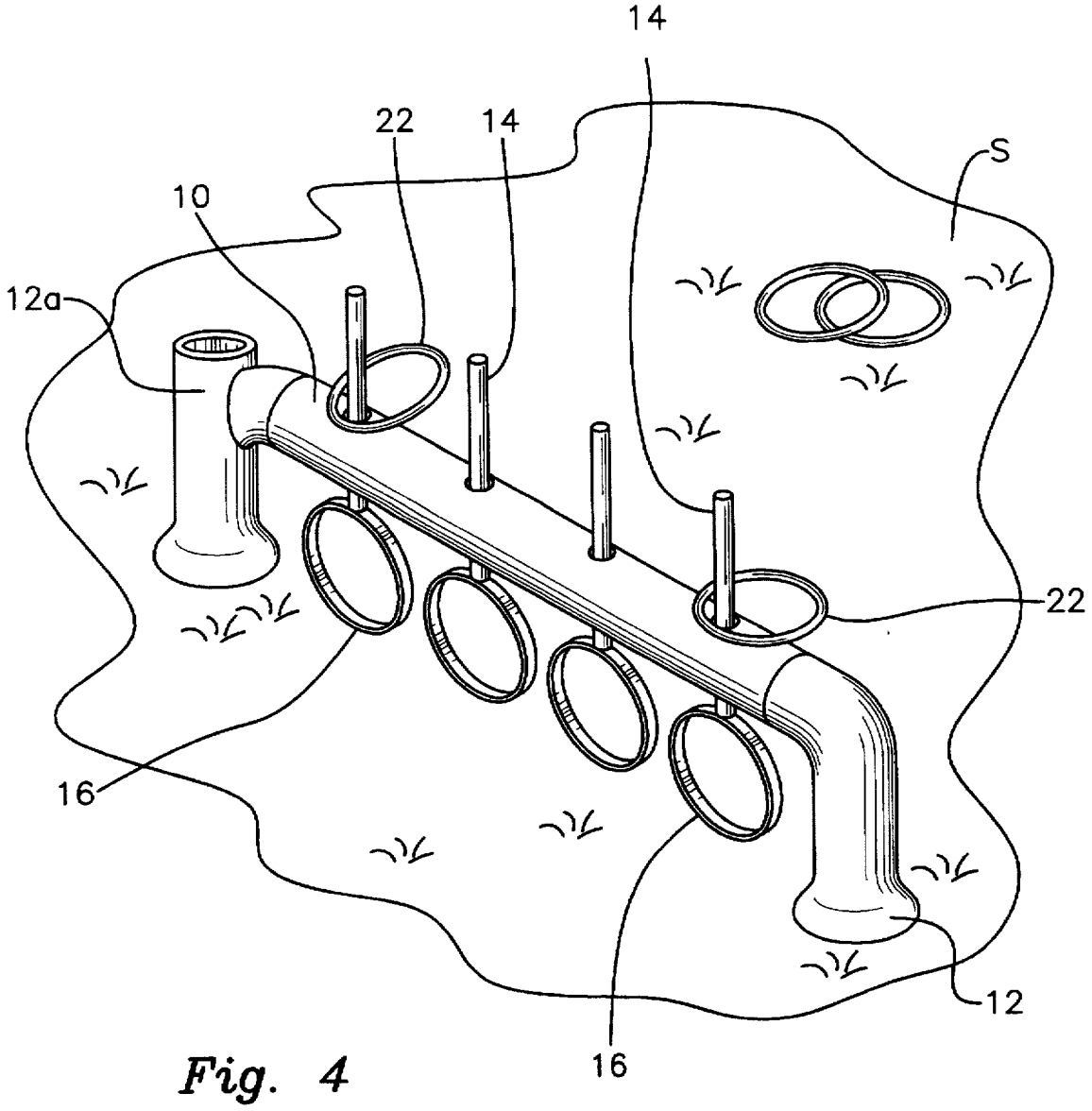
FIG. 4 is an elevated view in perspective of the embodiment of FIG. 1 in use and configured for a ring game.
Figure 5A:
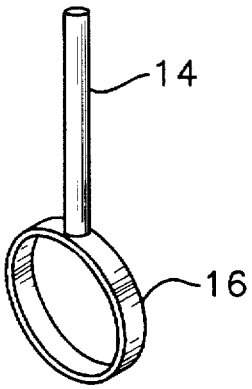
FIGS. 5A–5I illustrate examples of different configurations of the loop member and bar components of one embodiment of this invention.
Figure 5B:
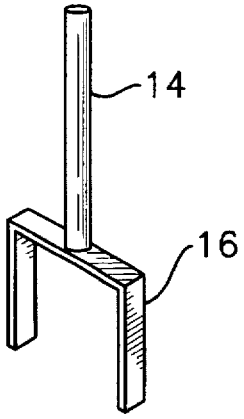
Figure 5C:
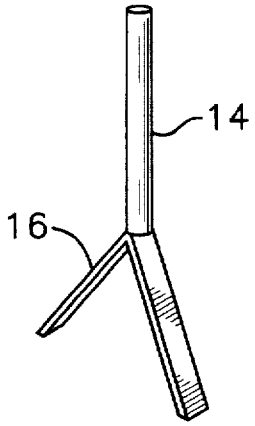
Figure 5D:
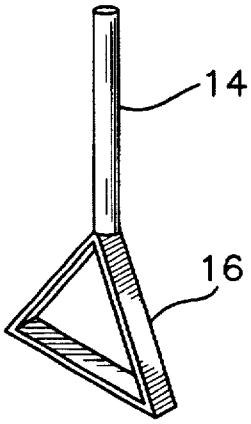
Figure 5E:
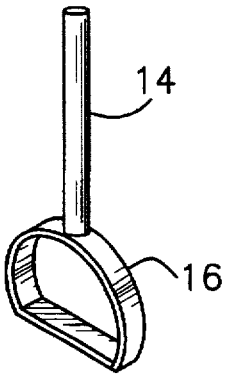
Figure 5F:
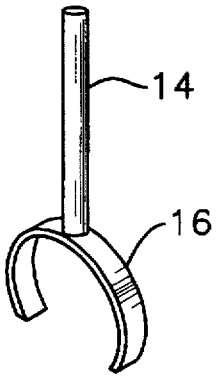
Figure 5G:
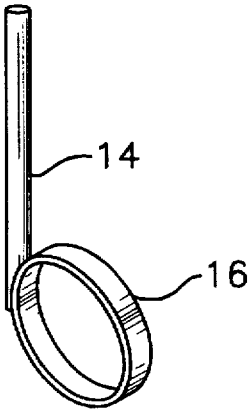
Figure 5H:
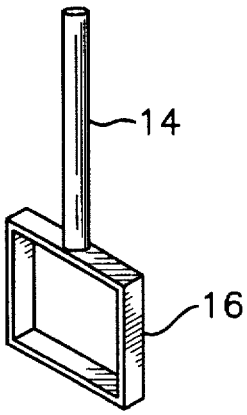
Figure 5I:
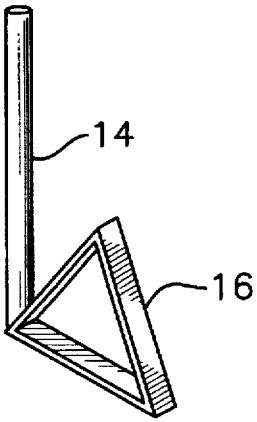

FIG. 3 illustrates the line of travel L for ball 18 through loop members 16 when loop members 16 are rotatably connected to shafts 10 and are in use to play an exemplary game in which the object is to roll the ball through each of the loops from one end of one shaft to the opposite end of the opposite shaft. Club 20 (see FIG. 1) may be used to apply force to roll the ball, and the loop members 16 may be rotated about the vertical axis extending through their respective bars 14 to make the task more or less challenging. The club of this invention may take other forms such as, for example, a stick, a bat, a hammer, or the like. The game may be played by one or more persons, the first person to complete the course being the winner of the game. FIG. 4 illustrates another game of this invention in which bars 14 extend through shaft 10 to receive rings 22 in a game in which the object is to be the first player to successfully place all or a certain number of rings around a bar. Each ring has an inner diameter sufficient in length to enable the ring to surround at least one of the bars when the longitudinal axis of the bar extends through the aperture formed by the ring. The inner diameter of each ring is preferably about 5 to about 15 times greater than the greatest width of the bar as measured in radial cross-section of the bar. Of course, in each of these games, the game rules may be varied widely to add variety and complexity to the objects of the game, and all are within the scope of this invention. In addition, games of this invention may include the use of more than one game feature. For example, a game of this invention enables the combined use of balls and rings in competitive games having two or more players. One such game might employ a scoring system based upon the number of rings accurately tossed and the number of loop members through which a player rolls his or her ball.

The loop members of this invention may take the form of a variety of different shapes and sizes. In addition, the bars of this invention may be attached at various points along the loop member periphery. Thus, as illustrated in FIGS. 5A–5I, loop member 16 may take the shape of a closed or open circle, a closed or open rectangle, an open or closed inverted U-shape, or a closed or opened triangle, for example. In addition, as can be seen from FIGS. 5G and 5I, bar 14 may be attached to loop member 16 at various points along the periphery of loop member 16. These examples are not intended to be limiting, but rather are intended to illustrate the wide variety of loop member shapes and configurations which may be employed in the practice of this invention. In addition, it is not required that the loop members of this invention be uniform in shape or size, as long as the balls of this invention may roll through the loop member when in use according to this disclosure. The diameter of the balls may vary widely, the only requirement being that the diameter be small enough to permit the balls to be rolled through at least one of the loop members when that loop member is rotatably connected to one of the shafts and is disposed below the shaft in contact with or in close proximity to the surface.

The various parts of the apparatus or game of this invention may be fabricated to exhibit a variety of colors. For example, different corresponding colors could be given to different game sets composed of a loop member, a ball and a club. In this way, the rules of the game could be modified to require each player to use a particular color-coordinated set of game components when competing. The various parts of the game structure also may be fabricated using one or more of a variety of materials, including plastics, metals, metal alloys, fiberglass, wood, and the like, and the selection of fabrication materials does not constitute a limitation of this invention. In addition, the dimensions of the various parts of the game structure, with the except ion of the bars connected to the loop members discussed above, may vary widely. The shaft is typically in the range of about 3 to about 6 feet in length, and when supported by the support members will typically be disposed above the surface a distance in the range of about 1 to about 3 feet. Another feature of this invention is that it enables users to play games in small, confined spaces (e.g., spaces which are in the size range of about 25 to about 40 square feet) if necessary. Preferably, the various parts of the game structure of this invention are sized to facilitate storage and transportation of the structure, and to provide a game which may be played in a small or confined space.

This invention is susceptible to considerable variation in its practice. Therefore, the foregoing description is not intended to limit, and should not be construed as limiting, the invention to the particular exemplifications presented hereinabove. Rather, what is intended to be covered is as set forth in the ensuing claims and the equivalents thereof permitted as a matter of law.

What is claimed is:

1. A game structure for use on a horizontal or substantially horizontal surface, the structure comprising:

a) a shaft; and b) one or more loop members;

the shaft including two support members extending from each end of the shaft for supporting the shaft in a horizontal or substantially horizontal position above the surface; and each loop member occupying a respective plane and being rotatably connected or connectable to the shaft at the loop periphery so that when the loop member is disposed below the shaft and in contact with or in close proximity to said surface, the loop member may rotate about a vertical or substantially vertical axis which extends through the respective plane.

2. The game structure according to claim 1 wherein each loop member has connected thereto a bar which extends radially from the loop periphery along the axis of loop member rotation and which is sized and configured to be rotatably connectable to the shaft and to extend above the shaft an appreciable distance when connected to the shaft and when the loop member is disposed below the shaft in contact with or in close proximity to said surface.

3. The game structure according to claim 2 wherein the appreciable distance is at least about 3 inches.

4. A game structure for use on a horizontal or substantially horizontal surface, the structure comprising:

a) two or more shafts; and b) a plurality of loop members;

each shaft comprising two support members extending from each end of the shaft for supporting the shaft in a horizontal or substantially horizontal position above the surface; and each loop member occupying a respective plane and being rotatably connected or connectable to the shaft at the loop periphery so that when the loop member is disposed below the shaft and in contact with or in close proximity to said surface, the loop member may rotate about a vertical or substantially vertical axis which extends through the respective plane.

5. The game structure according to claim 4 wherein each loop member has connected thereto a bar which extends radially from the loop periphery along the axis of loop member rotation and which is sized and configured to be rotatably connectable to one of the shafts respectively and to extend above the shaft an appreciable distance when connected to the shaft and when the loop member is disposed below the shaft and in contact with or in close proximity to said surface.

6. The game structure according to claim 5 wherein the appreciable distance is at least about 3 inches.

7. A game playable on a horizontal or substantially horizontal surface, the game comprising:

a) the game structure in accordance with claim 5; and b) a plurality of rings;

each ring being characterized by an inner diameter sufficient to enable the ring to surround at least one of the bars.

8. The game according to claim 7 wherein the appreciable distance is at least about 3 inches.

9. The game according to claim 7 further comprising one or more balls, each ball being characterized by a diameter which is sufficiently small to enable the ball to be rolled through at least one loop member when the loop member is rotatably connected to one of the shafts and disposed below the shaft in contact with or in close proximity to said surface.

10. The game according to claim 9 further comprising:

a) a net; and b) two or more poles;

each pole being connected or connectable to one of the shafts respectively and extending above the shaft when connected thereto and when the shaft is supported by the support members, whereby the net may be deployed to extend from one pole to the other.

11. The game according to claim 9 further comprising one or more clubs for applying force necessary to roll the balls.

12. The game according to claim 11 further comprising:

a) a net; and b) two or more poles;

each pole being connected or connectable to one of the shafts respectively and extending above the shaft when connected thereto and when the shaft is supported by the support members, whereby the net may be deployed to extend from one pole to the other.

13. A game playable on a horizontal or substantially horizontal surface, the game comprising:

a) the game structure in accordance with claim 4;

b) one or more balls;

each ball being characterized by a diameter which is sufficiently small to enable the ball to be rolled through at least one loop member when the loop members are rotatably connected to the shafts.

14. The game according to claim 13 further comprising:

a) a net; and b) two or more poles;

each pole being connected or connectable to one of the shafts respectively and extending above the shaft when connected thereto and when the shaft is supported by the support members, whereby the net may be deployed to extend from one pole to the other.

15. The game according to claim 13 further comprising one or more clubs for applying force necessary to roll the balls.

16. The game according to claim 15 further comprising:

a) a net; and b) two or more poles;

each pole being connected or connectable to one of the shafts respectively and extending above the shaft when connected thereto and when the shaft is supported by the support members, whereby the net may be deployed to extend from one pole to the other.

17. A game playable on a horizontal or substantially horizontal surface, the game comprising:

a) the game structure in accordance with claim 4;

b) a net; and c) two or more poles;

each pole being connected or connectable to one of the shafts respectively and extending above the shaft when connected thereto and when the shaft is supported by the support members, whereby the net may be deployed to extend from one pole to the other.

* * * * *